US007021846B2

(12) United States Patent
Woodman et al.

(10) Patent No.: US 7,021,846 B2
(45) Date of Patent: Apr. 4, 2006

(54) METHOD AND APPARATUS FOR PRODUCING LAMINATED LABELS

(75) Inventors: Michel Woodman, Huntingdon (GB); Clive Lawrence Ayling, Hauxton (GB); Robert Charles Lewis Day, Bassingbourn (GB)

(73) Assignee: Esselte, Sint-Niklaas (BE)

( * ) Notice: Subject to any disclaimer, the term of this patent is extended or adjusted under 35 U.S.C. 154(b) by 0 days.

(21) Appl. No.: 10/472,120

(22) PCT Filed: Mar. 19, 2002

(86) PCT No.: PCT/GB02/01256

§ 371 (c)(1),
(2), (4) Date: Apr. 9, 2004

(87) PCT Pub. No.: WO02/074551

PCT Pub. Date: Sep. 26, 2002

(65) Prior Publication Data

US 2004/0159252 A1 Aug. 19, 2004

(30) Foreign Application Priority Data

Mar. 20, 2001 (GB) ..... 0106971

(51) Int. Cl.
*B41J 2/315* (2006.01)

(52) U.S. Cl. ..... 400/120.03; 400/120.01; 400/120.02; 428/913; 503/208

(58) Field of Classification Search ..... 400/120.01, 400/120.02, 120.03, 120.08; 503/208, 200; 428/913, 914

See application file for complete search history.

(56) References Cited

U.S. PATENT DOCUMENTS

| | | | | | |
|---|---|---|---|---|---|
| 4,421,560 | A | * | 12/1983 | Kito et al. | 106/31.2 |
| 5,122,413 | A | * | 6/1992 | Ohno et al. | 428/319.9 |
| 5,310,222 | A | * | 5/1994 | Chatwin et al. | 283/86 |
| 5,474,968 | A | * | 12/1995 | Norimatsu | 503/226 |
| 5,508,247 | A | * | 4/1996 | Tran et al. | 503/200 |
| 5,532,201 | A | * | 7/1996 | Goto | 503/213 |
| 5,747,156 | A | * | 5/1998 | Hashiba et al. | 428/328 |
| 5,925,593 | A | | 7/1999 | Salgado et al. | |
| 5,948,727 | A | * | 9/1999 | Hotta et al. | 503/200 |
| 6,023,283 | A | * | 2/2000 | Imai | 347/212 |
| 6,060,425 | A | * | 5/2000 | Morohoshi et al. | 503/200 |
| 6,096,683 | A | * | 8/2000 | Amano et al. | 503/208 |
| 6,491,460 | B1 | * | 12/2002 | Sodeyama et al. | 400/613.1 |
| 6,770,592 | B1 | * | 8/2004 | Suzuki et al. | 503/201 |

FOREIGN PATENT DOCUMENTS

| | | | |
|---|---|---|---|
| EP | 322919 | | 7/1989 |
| EP | 0593270 | A2 * | 4/1994 |
| EP | 0748700 | A1 * | 12/1996 |
| WO | WO 9812053 | A1 * | 3/1998 |

* cited by examiner

*Primary Examiner*—Andrew H. Hirshfeld
*Assistant Examiner*—Dave A. Ghatt
(74) *Attorney, Agent, or Firm*—Morgan Lewis & Bockius LLP

(57) ABSTRACT

A method of printing an image on a composite medium is described. A composite medium comprises a thermally sensitive image receiving layer and a protective layer. The image receiving layer is activated through the protective layer whereby to generate an image in the image receiving layer which is protected by the already present protective layer. A tape and cassette comprising the composite medium are also described, as it is a printing device for use with the composite medium, and a method of producing a printed label from the composite medium.

23 Claims, 4 Drawing Sheets

METHOD AND APPARATUS FOR PRODUCING LAMINATED LABELS

FIELD OF THE INVENTION

The present invention relates to a method of printing on an image receiving medium, such as a tape, and to a thermal printer and tape to be used in such a method. In particular, the present invention relates to printing "laminated" labels, that is those where the printed image is protected in the finished product.

Thermal printers of the type with which the present invention is concerned are known, that is those that can produce labels in which the image is protected. They operate by printing an image onto an image receiving substrate, and performing a subsequent "laminating" step. In one type of known printer, this is achieved by printing an image onto a tape comprising an upper image receiving layer secured to a backing layer by an adhesive. Subsequently, a transparent layer is then affixed over the upper image receiving layer to protect the printed image.

BACKGROUND OF THE INVENTION

In another type of known printer, for example described in EP-A-322919 a mirror image of the image to be displayed is transferred onto a transparent image receiving tape allowing the image to be viewed through the other side of the tape. A double sided adhesive tape is then secured at one of its adhesive coated sides to the image receiving side of the transparent image receiving tape after the image has been printed. The other adhesive side of the double sided adhesive tape is covered by a removable backing layer.

In both of these devices the image is printed on the image receiving substrate before the layers of the finished composite label are joined. That is, it is necessary to apply a "laminating" or protective layer to the image receiving tape on which the image is printed. As a result it is necessary to supply the printing device with separate tapes providing the laminating and the image receiving layer. A disadvantage of such an arrangement is the need to align the layers to form the composite label once the image has been printed, using guide rollers or the like. A second disadvantage is that the printing device must house the tapes forming each of the layers separately, or the "laminating" tape is dispensed outside the printing device.

The print head for such printing apparatus generally comprises a plurality of printing elements which are selectively activated, that is heated. An image is generated in one of two ways. An intermediate ink ribbon can be provided so that when the activated printing elements of the print head heat up the ink from the parts of the ink ribbon in contact with the heated printing elements is transferred to the image receiving tape. Alteratively, the heated printing elements may directly contact a thermally sensitive image receiving tape which causes an image to be formed thereon by thermal activation.

SUMMARY OF THE INVENTION

According to one aspect of the present invention there is provided a method of printing an image on a composite medium which comprises a thermally sensitive image receiving layer and a protective layer, the method comprising activating the thermally sensitive image receiving layer through the protective layer, whereby the image is protected.

In the described embodiment the composite medium further comprises a removable backing layer, the image receiving layer being interposed between the removable backing layer and the protective layer.

According to a second aspect of the present invention there is provided a tape supply comprising a thermally sensitive image receiving layer which has not yet been thermally activated to generate an image and a protective layer on the upper surface of the image receiving layer in which the image is to be generated.

In the described embodiment the thermally sensitive image receiving layer comprises a thermochromic layer and a carrier layer.

In the described embodiment the protective layer of the composite tape is in the range of 3 μm to 15 μm thick According to a third aspect of the present invention there is provided a cassette holding a supply of composite tape, said tape comprising a thermally sensitive image receiving layer which has not yet been thermally activated to generate an image and a protective layer on the upper surface of the image receiving layer in which the image is to be generated.

In the described embodiment the composite tape may be supplied from a single supply spool housed in the cassette.

According to a fourth aspect of the present invention there is provided a printing device in conjunction with a composite tape, where said printing device comprises a thermal print head, drive means operable to cause relative motion between the print head and the composite tape, a cassette bay for housing a supply of the composite tape, control means operable to control the thermal energy generated at the print head and cutting means operable to cut off a portion of the composite tape, and where said tape comprises a thermally sensitive image receiving layer having a removable backing layer on its lower surface and a protective layer on its upper surface, and where the activation of the print head activates the thermally sensitive image receiving layer of the composite tape through the protective layer, whereby the printed image is protected.

According to a fifth aspect of the present invention there is provided a method of producing a printed label on a composite tape which comprises a thermally sensitive image receiving layer, a removable backing layer and a protective layer, the image receiving layer being interposed between the removable backing layer and the protective layer, the method comprising activating the thermally sensitive layer through the protective layer to generate an image and without any intermediate coating or laminating steps, cutting off a portion of the composite tape to produce the printed label in which the image is protected by the protective layer.

For a better understanding of the present invention, and to show how the same may be carried into effect, reference will now be made by way of example to the accompanying drawings.

DESCRIPTION OF THE PREFERRED EMBODIMENT

Figure 1:
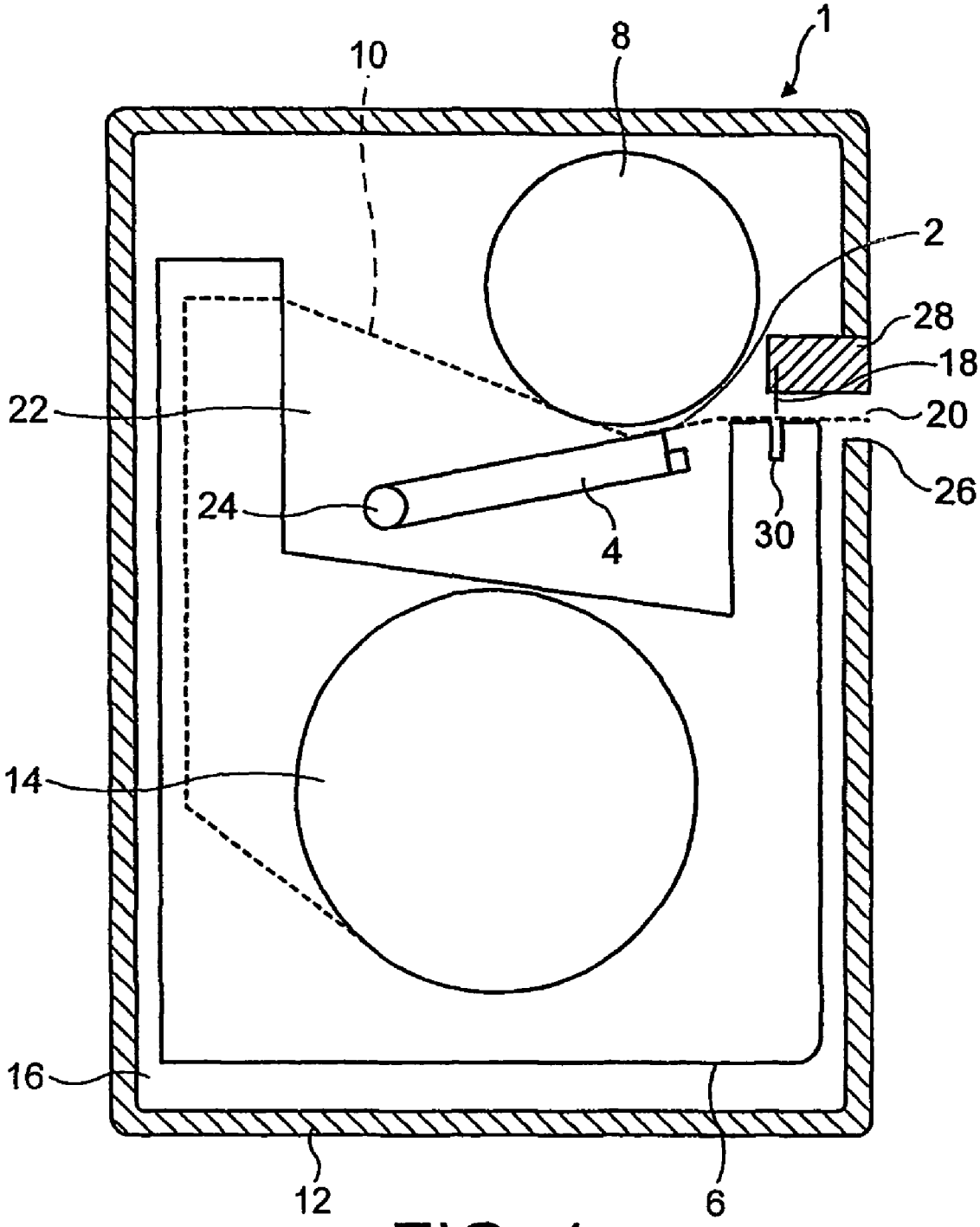
FIG. 1 is a schematic cross sectional view of a tape printing device embodying the present invention.

FIG. 1 shows in plan view a tape printing device 1 embodying the present invention which has a cassette 6 arranged therein. Typically this tape printing device 1 is a hand-held or small desktop device. The cassette 6 is located in a cassette bay 16 and contains a supply spool 14 of a composite image receiving tape 10. The cassette bay 16 also accommodates a thermal print head 4 and a platen 8 which cooperate to define a print zone 2. The print head 4 is able to pivot about a pivot point 24 so that it can be brought into contact with the platen 8 for printing and moved away from the platen 8 to enable the cassette 6 to be removed and replaced. In the operative position, the platen 8 is rotated to cause the composite image receiving tape 10 to be driven past the print head 4 and the print head is controlled to print an image on the composite image receiving tape 10 by directly heating the composite image receiving tape 10. The print head 4 comprises a thermal print head having an array of printing elements connected in parallel, each of which can be thermally activated in accordance with the desired image to be printed. The composite image receiving tape 10 is guided by a guide mechanism (which is not shown) through the cassette 6 to an outlet 26 of the tape printing device 1.

The platen 8 is driven by a DC motor 7 (see FIG. 4) so that it rotates to drive the composite image receiving tape 10 through the print zone 2 of the tape printing device 1 during printing. In this way, an Image is printed on the tape and fed out from the print zone 2 to the outlet 26.

The image is printed by the print head 4 on the composite image receiving tape 10 on a column by column basis with the columns being adjacent one another in the direction of movement of the tape 10. Pixels are selectively activated in each column to construct an image in a manner well known in the art. The DC motor 7 is provided with a shaft encoder for monitoring the speed of rotation of the motor. Sequential printing of the columns of pixels by the print head 4 is controlled in dependence on the monitored speed of rotation of the motor 7. The control of the speed of the motor 7 is achieved by the microprocessor chip 100 (see FIG. 4) to generate data strobe signals each of which causes a column of pixel data to be printed by the print head 4.

The tape printing device 1 may include at cutting location 20 a cutting mechanism 28 which carries a blade 18. The blade 18 cuts the composite image receiving tape 10 then enters a slot 30 located in the cassette 6.

Figure 2:
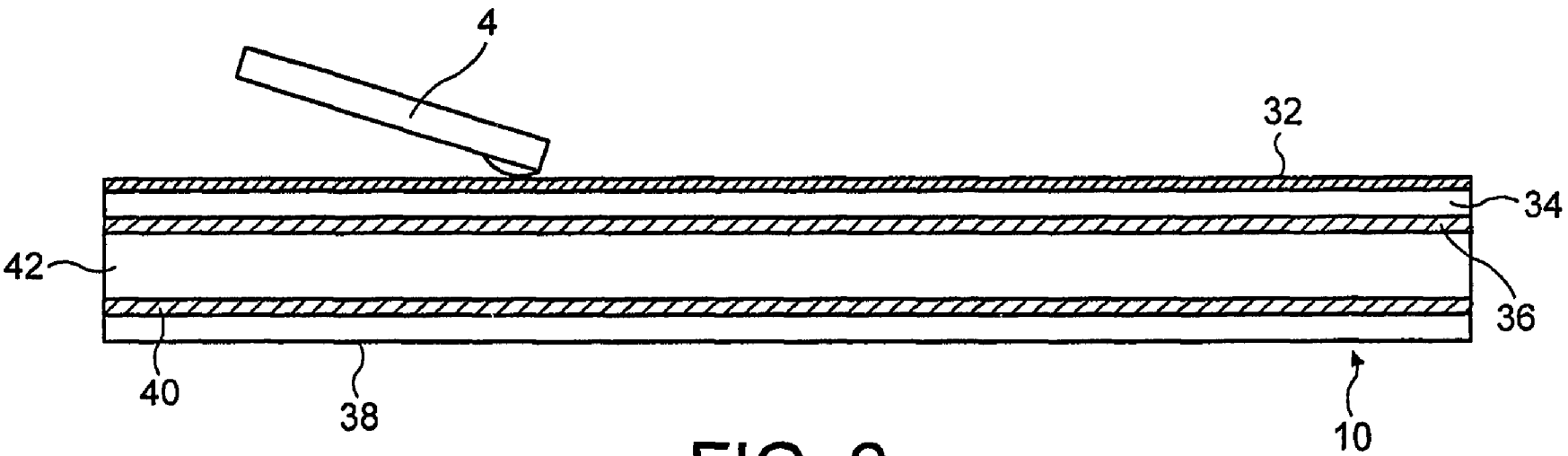
FIG. 2 shows in side view the composite image receiving tape showing each layer of the tape.

FIG. 2 shows a side view of a composite image receiving tape 10 to be used in accordance with a preferred embodiment of the present invention. A thermally sensitive substrate layer 42 is attached at its lower surface to a removable backing layer 38 by a glue layer 40 and attached at its upper surface to a very thin transparent layer of polyolefin or polypropylene 34, typically having a thickness in the range 3 μm–15 μm for example, by a further glue layer 36. A wax coating 32 covers the upper surface of the transparent layer 34. The print head 4 of tape printing device 1 shown in FIG. 1 is also shown.

Figure 3:
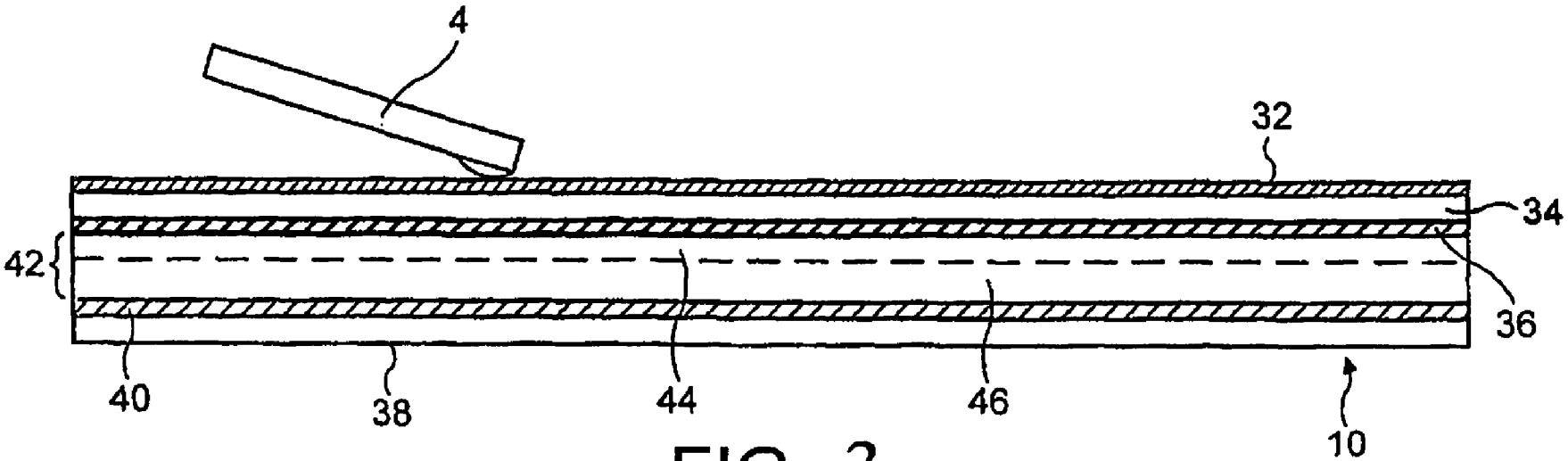
FIG. 3 shows in side view the composite image receiving tape showing each layer of the tape and each layer of the thermally sensitive image receiving substrate.

As illustrated in FIG. 3 the thermally sensitive substrate layer 42 may comprise a thermochromic layer 44 which combines a leuco dye with an acid colour developer in a binder matrix applied to a carrier material 46. An example of a dye which may be used is 3-diethylamino 6-methyl 7-aniline fluorine. The acid colour developer in the binder matrix may be p-hydrobenzolc acid (PHBB). Examples of materials which may be used for the binder include polyvinyl acetate, polyvinyl alcohol, methylcellulose, hexylethylcellulose, starch, styrene-maleic acid copolymer and styrenebutadiene polymer dispersions. The carrier material 46 may be a paper, metallic or plastic substrate.

There are many different types of thermally sensitive substrates which are well known in the art and which may be used in preference to the examples given.

Therefore embodiments of this invention are not limited to the materials listed above.

The microprocessor 100 controls the energy supplied to the printing elements of the print head 4 such that the heat gradient produced across the wax coating 32, the transparent layer 34 and the glue layer 36 is sufficiently high to cause an image to be formed on the thermal sensitive substrate 42. The temperature to which the print head 4 must be heated during the printing of an image is dependent on the thickness and thermal conductivity of the layers 32, 34 and 36 which are between the print head 44 and the thermal sensitive substrate.

The energy generated in each printing element is given by the equation:

$$E=(v^2\times t)/R \qquad \text{Equation 1}$$

where E is the energy generated at each printing element, v is the voltage applied across the printing element, R is the resistance of the printing element and t represents the length of time that the printing element is activated.

In one embodiment of the present invention the energy generated at each printing element may be controlled by regulating the voltage across the print head 4 such that the voltage supplied across each printing element is constant irrespective of the number of print elements that are activated. (Voltage regulators are well known in the art and will not be described herein). Assuming that the resistance of each printing element is constant, the predetermined energy may then be generated at the printing element by activating the print elements for a predetermined strobe time, controlled by the microprocessor chip 100.

Alternatively the energy generated at each printing element may be controlled by measuring the voltage across the print head and adjusting the strobe time accordingly. Hence, in a further embodiment of the present invention the voltage is read by the microprocessor and the correct strobe time calculated using an algorithm derived from Equation 1, or identified on a look up table, such that the predetermined energy is generated at each printing element.

If the temperature of the print head 4 is too high, this will cause the layers of the composite image receiving tape 10 between the thermal sensitive substrate 42 and the print head 4 to melt thereby deforming the structure of the composite image receiving tape 10 and affecting the appearance of the labels produced. However if the temperature of the print head is too low, a small temperature gradient through the layers between the print head 4 and the thermal sensitive substrate 42 will cause the heat to dissipate along the length of the composite image receiving tape 10 thereby producing an unclear image on the thermal sensitive substrate 42.

Figure 4:
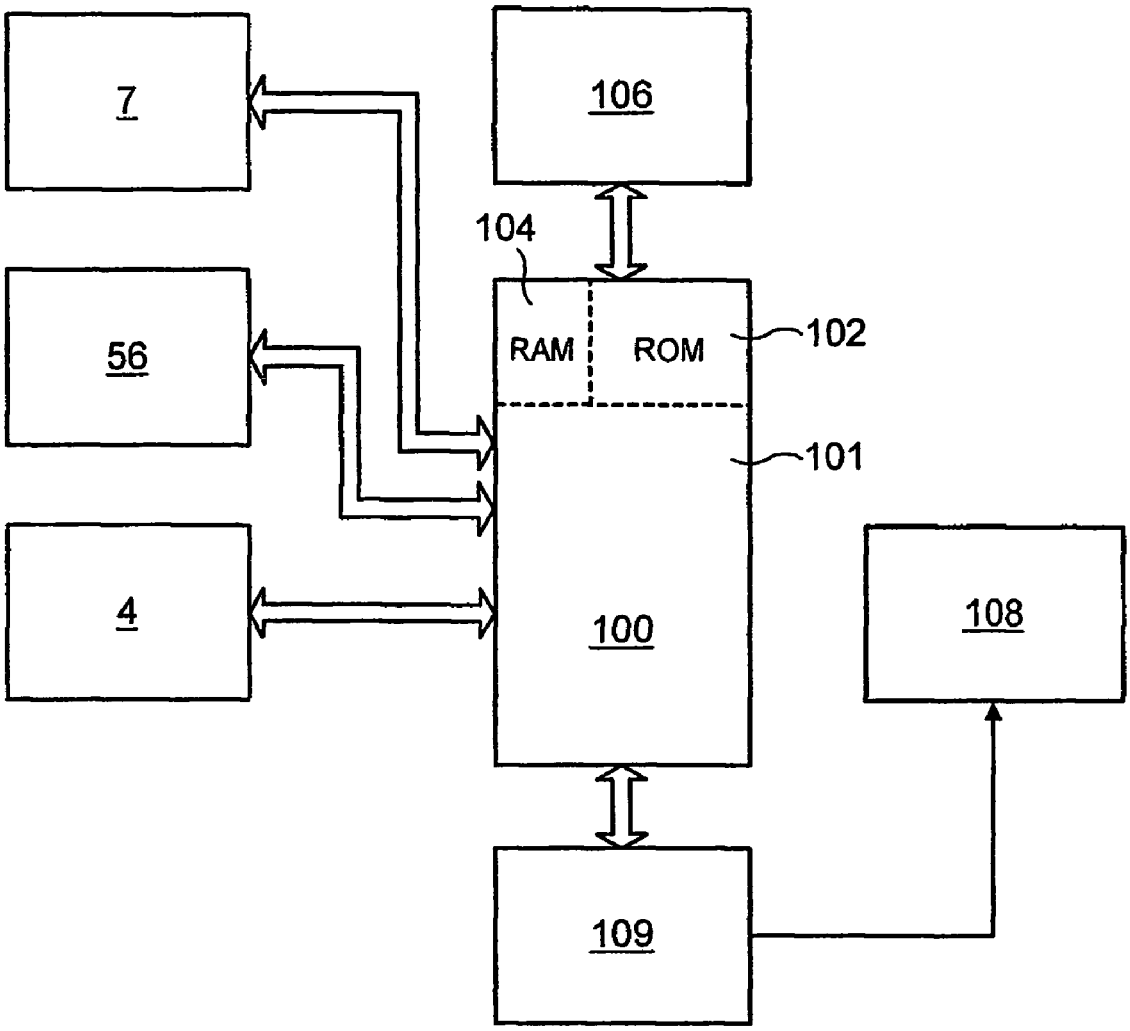
FIG. 4 is a diagrammatic sketch showing control circuitry for the printing device of FIG. 1.

The basic circuitry for controlling the present invention of the printing device 1 of FIG. 1 is shown in FIG. 4. There is a microprocessor 100 chip having a read only memory (ROM) 102, a microprocessor 101 and random access memory capacity (RAM) 104. The microprocessor chip 100 outputs data to drive a display 108 via a display driver chip 109 to display a label to be printed (or part thereof) and/or a message for the user. The display driver alternatively may form part of the microprocessor chip. Additionally, the microprocessor chip 100 also outputs data to drive the print head 4 to form a label. The microprocessor chip 100 also controls the DC motor 7 driving the platen 8. The microprocessor may also control the cutting mechanism 28 to allow lengths of tape to be cut off.

The invention claimed is:

1. A composite tape supply comprising:

a thermally sensitive image receiving layer which has not yet been thermally activated to generate an image, said thermally sensitive image receiving layer comprising a thermochromic layer and a carrier layer, a protective layer of polypropylene or other polyolefin, on an upper surface of the image receiving layer in which the image is to be generated, and a glue layer between the protective layer and the upper surface of the thermally sensitive image receiving layer.

2. A tape supply as claimed in claim 1 further comprising a removable backing layer, the image receiving layer being interposed between the removable backing layer and the protective layer.

3. The tape supply as claimed in claim 2 where the carrier layer is a paper substrate.

4. The tape supply as claimed in claim 2 where the carrier layer is a plastic substrate.

5. The tape supply as claimed in claim 2 where the carrier layer is a metallic substrate.

6. The tape supply as claimed in claim 2 further comprising an adhesive layer between the removable backing layer and a lower surface of the thermally sensitive image receiving layer.

7. The tape supply as claimed in claim 1 where a top surface of said protective layer is coated in a friction reducing material.

8. The tape supply as claimed in claim 1 where the thickness of the protective layer is about 3 μm to about 15 μm.

9. The composite tape of claim 1 wherein the polyolefin is polypropylene.

10. The composite tape of claim 1, wherein the composite tape further comprises a layer of wax disposed on an upper surface of the protective layer.

11. The composite tape supply of claim 1 further comprising a cassette adapted to hold the composite tape supply, said tape being disposed within the cassette.

12. The composite tape supply of claim 11 where said composite tape further comprises a removable backing layer disposed such that the image receiving layer is interposed between the removable backing layer and the protective layer.

13. A method of printing an image on a composite medium, the method comprising:

providing a composite medium comprising a thermally sensitive image receiving layer, said thermally sensitive image receiving layer comprising a thermochromic layer and a carrier layer, said composite medium further comprising a protective layer of polypropylene or other polyolefin, and a glue layer disposed between the protective layer and an upper surface of the thermally sensitive image receiving layer, and activating the thermally sensitive image receiving layer through the protective layer, whereby the image is protected.

14. The method according to claim 13 where the composite medium further comprises a removable backing layer, the image receiving layer being interposed between the removable backing layer and the protective layer.

15. The method according to claim 14 where the composite medium is a composite tape further comprising an adhesive layer disposed between the image receiving layer and the removable backing layer.

16. The method of claim 13 wherein the polyolefin is polypropylene.

17. A tape printer comprising a printhead and means for receiving a cassette, whereby said cassette holds a supply of composite tape, the tape comprising a thermally sensitive image receiving layer, said thermally sensitive image receiving layer comprising a thermochromic layer and a carrier layer, said composite medium further comprising a protective layer of polypropylene or other polyolefin, on an upper surface of the image receiving layer and a glue layer between the protective layer and the upper surface of the image receiving layer, wherein the printhead is activatable to provide a thermal energy sufficient to generate an image in the thermally sensitive image receiving layer by activating said layer through said protective layer.

18. The tape printer comprising means for receiving a cassette, whereby said cassette holds a supply of composite tape of claim 17, wherein the polyolefin is polypropylene.

19. A printing device in conjunction with a composite tape, where said printing device comprises a thermal printhead, drive means operable to cause relative motion between the printhead and the composite tape, a cassette bay for housing a supply of the composite tape, control means operable to control the thermal energy generated at the printhead, and cutting means operable to cut off a portion of the composite tape, and where said tape comprises a thermally sensitive image receiving layer comprising a thermochromic layer and a carrier layer, and a removable backing layer on a lower surface of said thermally sensitive image receiving layer, said composite tape further comprising a protective layer of polypropylene or other polyolefin, on an upper surface of said thermally sensitive image receiving layer, and a glue layer between the protective layer and the upper surface of the thermally sensitive image receiving layer, and where during use the activation of the printhead activates the thermally sensitive image receiving layer of the composite tape through the protective layer to form a printed image, whereby the printed image is protected.

20. The printing device in conjunction with a composite tape of claim 19 wherein the polyolefin is polypropylene.

21. A method of producing a printed label on a composite tape, said method comprising:

providing a composite tape which comprises a thermally sensitive image receiving layer, comprising a thermochromic layer and a carrier layer, a removable backing layer, a protective layer of polypropylene or other polyolefin, and a glue layer between the protective layer and an upper surface of the thermally sensitive image receiving layer, the image receiving layer being interposed between the removable backing layer and the protective layer, the method comprising activating the thermally sensitive layer through the protective layer to generate an image and without an intermediate coating or laminating steps, cutting off a portion of the composite tape to produce the printed label in which the image is protected by the protective layer.

22. The method of claim 21 wherein the polyolefin is polypropylene.

23. A method of producing a printed label on a composite tape which comprises a thermally sensitive image receiving layer, a removable backing layer and a protective layer, the image receiving layer being interposed between the removable backing layer and the protective layer, wherein the protective layer comprises a polyolefin affixed to the image receiving layer with a layer of glue, the method comprising activating the thermally sensitive layer through the protective layer to generate an image and without an intermediate coating or laminating steps, cutting off a portion of the composite tape to produce the printed label in which the image is protected by the protective layer.

* * * * *